US006942588B2

(12) United States Patent
Barrie

(10) Patent No.: US 6,942,588 B2
(45) Date of Patent: Sep. 13, 2005

(54) BROADHEAD WITH FIXED REPLACEABLE BLADES

(75) Inventor: Bruce Barrie, Waseca, MN (US)

(73) Assignee: Barrie Archery, Waseca, MN (US)

( * ) Notice: Subject to any disclaimer, the term of this patent is extended or adjusted under 35 U.S.C. 154(b) by 0 days.

(21) Appl. No.: 10/756,180

(22) Filed: Jan. 13, 2004

(65) Prior Publication Data

US 2005/0153802 A1 Jul. 14, 2005

(51) Int. Cl.[7] ..... F42B 6/08
(52) U.S. Cl. ..... 473/584
(58) Field of Search ..... 473/583, 584

(56) References Cited

U.S. PATENT DOCUMENTS 2,940,758 A * 6/1960 Richter ..... 473/584
4,410,184 A * 10/1983 Anderson ..... 473/584
5,417,440 A * 5/1995 Barrie et al. ..... 473/584
5,482,293 A * 1/1996 Lekavich ..... 473/584
5,496,043 A * 3/1996 Ester ..... 473/584
5,636,845 A * 6/1997 Newnam ..... 473/583
5,871,410 A * 2/1999 Simo et al. ..... 473/583
6,077,180 A * 6/2000 Adams, Jr. ..... 473/584
6,554,727 B1 * 4/2003 Armstrong et al. ..... 473/584

* cited by examiner

*Primary Examiner*—John A. Ricci
(74) *Attorney, Agent, or Firm*—Patterson, Thuente, Skaar & Christensen, P.A.

(57) ABSTRACT

A broadhead for use with an arrow, includes a one piece body having a penetrating end, a shank formed integral therewith and depending from the penetrating end and an arrow engaging end formed integral therewith and depending from the shank, a continuous circumferential blade retaining lip being defined on the one piece body. And, a plurality of replaceable main blades, each of the plurality of main blades having a leading edge and a trailing edge, a retaining edge being defined proximate the leading edge, the retaining edge of each of the plurality of blades being retainingly disposed in the continuous circumferential blade retaining lip when each of the main blades is operably coupled to the one piece body. A method of forming such a broadhead is further included.

26 Claims, 1 Drawing Sheet

Figure 1:
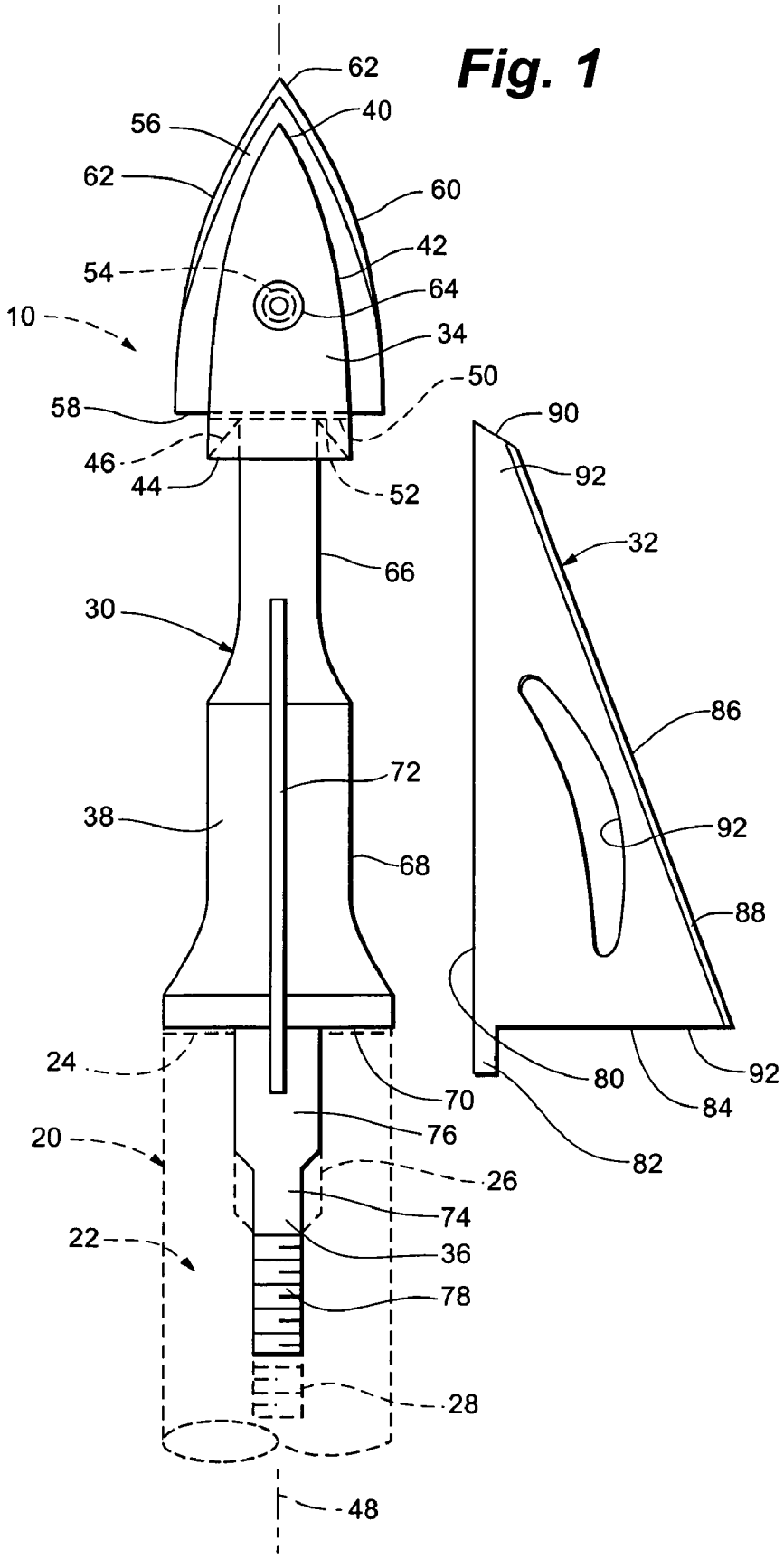

62
40
56
62
60
42
54
64
10
34
50
58
90
46
92
44
52
32
66
30
86
72
38
92
68
88
24
80
92
70
84
20
76
82
26
74
22
36
78
28
48

BROADHEAD WITH FIXED REPLACEABLE BLADES

TECHNICAL FIELD

The present invention relates to broadheads for use with arrows in hunting applications. More particularly, this application relates to broadheads with fixed replaceable main blades.

BACKGROUND OF THE INVENTION

Broadheads are well known for use with arrows, primarily in the sport of big game hunting. Broadheads are designed to give reliable, deep penetration and to generate a large wound channel in order to humanely dispatch the target animal.

Prior art broadheads including a number of different types. The first such type is an expandable broadhead having a retracted, inflight blade disposition in which the blade is held at least partially within the broadhead body. Upon impact, the blades expand outward to generate the required large wound channel. Such broadheads have the advantage of inflight stability and not the subject to the influence of cross winds. However, such broadheads are not of a relatively simple design, requiring some mechanism to shift the blades from the inflight-retracted disposition to the expanded penetrating disposition.

A further type of prior art broadhead is one that can be characterized as having fixed main blades that are not replaceable. Such broadheads are typically formed in a unitary integral manner. While such blades are extremely simple in construction, a bent or dull blade is not easily rectified.

A further type of prior art broadhead has fixed main blades that are replaceable by use of a multi-component body. The multi-component body may include a shank and a screw on penetrating tip. Removal of the penetrating tip from the shank allows the main blades to be replaced. Forming separate cooperative shanks and penetrating tips add significantly to the manufacturing cost of this type of broadhead.

Another type of prior art broadhead is a broadhead having fixed main blades that are replaceable and a unitary body. Such broadheads typically have a multi-faceted penetrating tip with a blade-retaining notch presented at the trailing edge of the intersection of two facets. The blade-retaining notch captures the leading edge of a single main blade. The notch is typically not much wider than the thickness dimension of the blade. A difficulty with such broadheads is that an off axis penetration by the broadhead tends to dislodge the blade leading edge from the blade retaining notch. The blade then disadvantageously separates from the broadhead body and does not penetrate the target.

What is needed in the industry then is a broadhead of simple unitary construction with readily replaceable main blades that has the reliability and penetrating characteristics of a broadhead having fixed main blades that are not replaceable.

SUMMARY OF THE INVENTION

The broadhead of the present invention substantially meets the aforementioned needs of the industry. The broadhead is simply constructed having a one-piece body to which a plurality of replaceable main blades are joined. The leading edge of each of the main blades is reliably retained within a continuous circumferential blade retaining lip defined on the body of the broadhead. Such design allows ready replacement of the main blades while at the same time ensuring that the main blades remain affixed to the broadhead body even during off axis penetrations.

The present invention is a broadhead for use with an arrow and includes a one piece body having a penetrating end, a shank formed integral therewith and depending from the penetrating end and an arrow engaging end formed integral therewith and depending from the shank, a continuous circumferential blade retaining lip being defined on the one piece body. And, additionally includes a plurality of replaceable main blades, each of the plurality of main blades having a leading edge and a trailing edge, a retaining edge being defined proximate the leading edge, the retaining edge of each of the plurality of blades being retainingly disposed in the continuous circumferential blade retaining lip when each of the main blades is operably coupled to the one piece body. The present invention is further a method of forming such a broadhead.

BRIEF DESCRIPTIONS OF THE DRAWINGS

FIG. 1 is a side elevational view of the broadhead of the present invention including the broadhead body and a single main blade spaced apart therefrom.

DETAILED DESCRIPTION OF THE DRAWINGS

The broadhead of the present invention is shown generally at 10 in the figure. The broadhead 10 is designed to be removably affixed to an arrow 20, depicted in phantom.

The arrow 20 is an elongate shaft 22. The shaft 22 terminates at a first end in a transverse end face 24. An axial bore 26 is defined depending from end face 24. The axial bore 26 may be a blind bore having a lower threaded bore portion 28.

The broadhead 10 of the present invention has a one-piece body 30 and a plurality of main blades 32. While only a single main blade 32 is depicted, it is understood that a plurality of blades, preferably from two to five blades may be a arrayed around the circumference of the body 30.

The one piece-body 30 of the broadhead 10 has three major subcomponents; a penetrating end 34 and a spaced apart opposed arrow engaging end 36 with a central shank 38 extending between the penetrating end 34 and the arrow engaging end 36.

The penetrating end 34 of the one-piece body 30 has a pointed penetrating tip 40. A tip margin 42 extends from the penetrating tip 40 to an orthogonally disposed tip base 44. The tip margin 42 preferably has a generally increasing diameter taken from the penetrating tip 40 to the tip base 44.

A continuous circumferential blade retaining lip 46 is defined inward and upward from the circumferential margin of the tip base 44. The circumferential blade retaining lip 46 preferably extends inward at an angle of between 15 and 75 degrees relative to the longitudinal axis 48 of the broadhead 10. Most preferably, the circumferential blade retaining lip 46 makes a 45-degree angle relative to the longitudinal axis 48.

A transverse tip blade slot 50 is defined in the upper portion of the penetrating tip 40. The tip blade slot 50 passes through the retaining tip 40, preferably intersecting both the longitudinal axis 48 and the penetrating tip 40. The tip blade slot 50 preferably extends upward from a transverse base 52 to the penetrating tip 40.

A tip blade bore 54 is defined through the penetrating end 34. Preferably, the tip blade bore 54 is disposed orthogonally with respect to the tip blade slot 50 and intersects the tip blade slot 50.

A tip blade 56 is preferably disposed in the tip blade slot 50. The tip blade 56 has a blade base 58 that is preferably orthogonally disposed relative to the longitudinal axis 48 and which abuts the base 52 of the tip blade slot 50.

The tip blade 56 has a pair of opposed cutting edges 60. Each of the cutting edges 60 may have a razor edge defined thereon and preferably extends from a tip 62 to the blade base 58. The cutting edges 60 may be curved and may mirror the shape of the tip margin 42.

A retainer 64 may be disposed in the tip blade bore 54. The retainer 64 passes through the tip blade bore 54 and a bore (not shown) defined in the tip blade 56 that is in registry with the tip blade bore 54. The retainer 64 may be a pin that is pressed in, or more preferably, is a small bolt that is threaded into the tip blade bore 54, which may be removed in order to replace the tip blade 56.

The shank 38 of the one-piece body 30 depends from the penetrating end 34. A cylindrical shank portion 66 extends from the inner margin of the circumferential blade retaining lip 46 downward to a bell shaped shank portion 68. The belled shank portion 68 has a generally increasing sectional diameter from the top to the bottom of the belled shank portion 68.

A blade groove 72 is defined in and extends beyond the upper margin and lower margin of the shank 38. A blade groove 72 is provided corresponding to each of the plurality of main blades 32 to be employed on the broadhead 10. The blade groove 72 is a blind groove having generally parallel, spaced apart side margins and a bottom margin that is parallel to the longitudinal axis 48. The distance of the bottom margin of the blade groove 72 from the longitudinal axis 48 is generally equal to the radius of the cylindrical shank portion 66 of the shank 38.

The arrow-engaging end 36 of the one-piece body 30 has a generally cylindrical shank 74 that depends from the shank 38 of the one-piece body 30. The shank 74 has an upper cylindrical portion 76 and a lower threaded portion 78. The lower threaded portion 78 is designed to threadably engage the threaded bore portion 28 of the axial bore 26 of the arrow 20.

The second major component of the broadhead 10 is the main blade 32. As noted above, there may be a plurality of main blades 32 employed with the broadhead 10. Preferably, there are between two and five main blades 32 and most preferably three blades 32. The main blades 32 are equiangularly displaced around the circumference of the one-piece body 30. A blade groove 72 is defined in the one-piece body 30 corresponding to each of the main blades 32 to be employed with the broadhead 10. The thickness of the main blades 32 is preferably slightly less than the width of the blade groove 72 so that a portion of the main blade 32 may be removably, supportively disposed within the blade groove 72.

The main blades 32 are generally triangular in shape. The main blade 32 has an axial edge 80. The axial edge 80 is a generally blunt edge and extends from a leading edge 92 of the blade 32, terminating at a trailing edge 96 in a retaining tail 82.

The retaining tail 82 comprises a relatively small depending projection formed integral with the blade 32. When the main blade 32 is assembled to the body 30, the retaining tail 82 projects downward from the shank base 70 of the shank 38 of the body 30 and is fully disposed within the portion of the blade groove 72 that is formed in the arrow-engaging end 36 of the body 30.

A base edge 84 is presented generally orthogonally with respect to the axial edge 80. The base edge 84 presents a generally blunt margin.

A cutting edge 86 extends angularly upward from the base edge 84. The cutting edge 86 preferably has a razor edge 88 presented at the margin of the cutting edge 86. At the leading edge 92 of the blade 32, the cutting edge 86 is joined to the base edge 84 by a retaining edge 90. The retaining edge 90 presents a generally blunt margin. The retaining edge 90 is designed to cooperate with the circumferential blade retaining lip 46 in order to secure the leading edge 92 of the blade 32 to the one-piece body 30 in a readily removable manner. Accordingly, the angle of the retaining edge 90 relative to the axial edge 80 is generally the same as the angle of the circumferential blade retaining lip 46 with respect to the longitudinal axis 48. Preferably, the angle of the retaining edge 90 relative to the axial edge 80 is 45 degrees.

A lightening slot having any desired shape may be defined in each of the blades 32.

In assembly, each of the blades 32 is positioned within a respective blade groove 72. In this disposition, the axial edge 80 of the blade 32 is generally parallel to and spaced apart from the longitudinal axis 48 of the body 30. The upper portion of the axial edge 82 lies flush with the exterior margin of the cylindrical shank portion 66. The lower portion of the axial edge 80 resides with the blade groove 72.

With the blades 32 held loosely in this disposition, the arrow 20 is threadably engaged with the broadhead 10. The threaded bore portion 28 of the arrow 20 is engaged with the lower threaded portion 78 of the arrow-engaging end 36. As the arrow 20 advances upward, the end face 24 of the arrow 20 bears on the base edge 84 of each of the blades 32, causing the retaining edge 90 to be retained within the circumferential blade retaining lip 46.

When the arrow 20 is snugged up against the broadhead 10, the end face 24 of the arrow 20 bears on the shank base 70 and the base edge 84 of the blade 32 is held flush with the shank base 70 of the shank 38.

In this disposition, the retaining tail 82 of the blade 32 is captured cooperatively within the blade groove 72 by the axial bore 26 of the arrow 20. In this manner, both the leading edge 92 and trailing edge 96 of each of the main blades 32 is held in engagement with the one-piece body 30.

To remove the blades 32 from the body 30, the arrow 20 is simply unthreaded from the broadhead 10. Holding the broadhead 10 as depicted in FIG. 1, as the arrow 20 retreats from the broadhead 10 the blades 32 will simply fall free from the one-piece body 30 when the retaining edge 90 has cleared the circumferential blade retaining lip 46.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A broadhead for use with an arrow, comprising:

a one-piece single component body having a penetrating end, a shank formed integral therewith and depending from the penetrating end and an arrow engaging end formed integral therewith and depending from the shank, a continuous circumferential blade retaining lip being defined on the one-piece single component body; and a plurality of replaceable main blades, each of the plurality of main blades being non-expandable and having a leading edge and a trailing edge, a retaining edge being defined proximate the leading edge, the retaining edge of each of the plurality of blades being retainingly disposed in the continuous circumferential blade retaining lip when each of the main blades is operably coupled to the one-piece single component body.

2. The broadhead of claim 1 having a tip blade operably coupled to the penetrating end of the one-piece single component body.

3. The broadhead of claim 2, wherein the tip blade is disposed in a transverse slot defined in the penetrating end of the one-piece single component body.

4. The broadhead of claim 2 wherein the tip blade is replaceably disposed in a transverse slot defined in the penetrating end of the one-piece single component body and held therein by a removable retainer, the retainer penetrating both the tip blade and the penetrating end.

5. The broadhead of claim 1, each of the plurality of blades having a lightening slot defined therein.

6. The broadhead of claim 1, each of the plurality of blades being held in operable engagement with the one-piece single component body by the arrow being operably coupled to the arrow engaging end of the one-piece single component body.

7. The broadhead of claim 1, each of the plurality of blades being held in operable engagement with the one-piece single component body at least in part by a respective groove defined in the one-piece single component body.

8. The broadhead of claim 7, each of the plurality of blades being free to translate in the respective groove defined in the one-piece single component body.

9. The broadhead of claim 1, the continuous circumferential blade retaining lip being defined at an intersection of the penetrating end and the shank.

10. The broadhead of claim 1, the continuous circumferential blade retaining lip being defined at an angle, the angle being directed inwardly and upwardly toward the penetrating end from a penetrating end circumferential margin.

11. The broadhead of claim 1, the continuous circumferential blade retaining lip being formed at an angle of between substantially 10 and 75 degrees relative to a broadhead longitudinal axis.

12. The broadhead of claim 11, the continuous circumferential blade retaining lip being formed at an angle of 45 degrees relative to the broadhead longitudinal axis.

13. A broadhead for use with an arrow, comprising:

a one-piece single component body, a continuous circumferential blade retaining lip being defined thereon, the continuous circumferential blade retaining lip being defined at an angle, the angle being directed inwardly and upwardly toward the penetrating end from a penetrating end circumferential margin;

a plurality of replaceable main blades, each of the plurality of main blades being non-expandable and having a leading edge and a trailing edge, a retaining edge being defined proximate the leading edge, the retaining edge of each of the plurality of blades being retainingly disposed in the continuous circumferential blade retaining lip when each of the main blades is operably coupled to the one-piece single component body; and a tip blade operably coupled to the penetrating end of the one-piece single component body.

14. The broadhead of claim 13, wherein the tip blade is disposed in a transverse slot defined in the penetrating end of the one-piece single component body.

15. The broadhead of claim 13 wherein the tip blade is replaceably disposed in a transverse slot defined in the penetrating end of the one piece single component body and held therein by a removable retainer, the retainer penetrating both the tip blade and the penetrating end.

16. The broadhead of claim 13, each of the plurality of blades having a lightening slot defined therein.

17. The broadhead of claim 13, each of the plurality of blades being held in operable engagement with the one-piece single component body by the arrow being operably coupled to the arrow engaging end of the one-piece single component body.

18. The broadhead of claim 13, each of the plurality of blades being held in operable engagement with the one-piece single component body at least in part by a respective groove defined in the one-piece single component body.

19. The broadhead of claim 18, each of the plurality of blades being free to translate in the respective groove defined in the one-piece single component body.

20. The broadhead of claim 13, the continuous circumferential blade retaining lip being defined at an intersection of the penetrating end and a shank.

21. The broadhead of claim 13, the continuous circumferential blade retaining lip being formed at an angle of between substantially 10 and 75 degrees relative to a broadhead longitudinal axis.

22. The broadhead of claim 21, the continuous circumferential blade retaining lip being formed at an angle of 45 degrees relative to the broadhead longitudinal axis.

23. A method of forming a broadhead for use with an arrow, comprising:

forming a one-piece single component body;

forming a continuous circumferential blade retaining lip defined thereon;

defining the continuous circumferential blade retaining lip at an angle, the angle being directed inwardly and upwardly toward the penetrating end from a penetrating end circumferential margin;

forming a plurality of replaceable main blades, each of the plurality of main blades being non-expandable and having a leading edge and a trailing edge, a retaining edge being defined proximate the leading edge;

retaining each of the plurality of blades in the continuous circumferential blade retaining lip when each of the main blades is operably coupled to the one-piece single component body; and forming a transverse slot in a penetrating end of the one-piece single component body, replaceably disposing a tip blade in the transverse slot, and retaining the tip blade therein by a removable retainer.

24. The method of claim 23 including holding each of the plurality of blades in operable engagement with the one-piece single component body at least in part by disposing a portion of each blade in a respective groove defined in the one-piece single component body.

25. The method of claim 23 including forming the continuous circumferential blade retaining lip at an angle of between 10 and 75 degrees relative to a broadhead longitudinal axis.

26. The broadhead of claim 25 including forming the continuous circumferential blade retaining lip at an angle of 45 degrees relative to the broadhead longitudinal axis.

* * * * *